US008717239B2

(12) United States Patent
Ko et al.

(10) Patent No.: US 8,717,239 B2
(45) Date of Patent: May 6, 2014

(54) MULTI-BAND ANTENNA

(75) Inventors: Ching-hsiang Ko, New Taipei (TW); Kai Shih, New Taipei (TW); Lan-yung Hsiao, New Taipei (TW); Jia-hung Su, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 233 days.

(21) Appl. No.: 13/301,777

(22) Filed: Nov. 21, 2011

(65) Prior Publication Data

US 2013/0127668 A1 May 23, 2013

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 2007/0236396 | A1* | 10/2007 | Gao | 343/702 |
| 2009/0231213 | A1* | 9/2009 | Ishimiya | 343/702 |
| 2010/0134358 | A1* | 6/2010 | Su et al. | 343/700 MS |
| 2011/0012790 | A1* | 1/2011 | Badaruzzaman et al. | 343/700 MS |

* cited by examiner

*Primary Examiner* — Dieu H Duong
(74) *Attorney, Agent, or Firm* — Cheng-Ju Chiang

(57) ABSTRACT

A multi-band antenna is disclosed and comprises a substrate and an electro-conductive layer. The electro-conductive layer comprises: a feed-in terminal; a ground terminal; a connecting portion extended forward from the feed-in terminal; a first high frequency portion extended leftward from the connecting portion for controlling a third frequency band; a low frequency portion bent and extended leftward from the connecting portion for controlling a first frequency band and a second frequency band; and a second high frequency portion extended rightward from the connecting portion for controlling a fourth frequency band. Furthermore, the second high frequency portion is connected with the ground terminal and wider than the first high frequency portion; and harmonic oscillations are generated between the second and first high frequency portions to control a fifth frequency band. Hence, the multi-band antenna of the present invention can meet the requirement of various communication standards.

5 Claims, 2 Drawing Sheets

MULTI-BAND ANTENNA

BACKGROUND OF THE INVENTION

1. Field of the Invention

The present invention relates to a field of communication equipment, and in particular to a multi-band antenna which has a compact size to meet the requirement of various communication standards.

2. The Related Arts

With the development of communication industries of high technology, the application of mobile communication, especially 4G communication technologies, is widely used nowadays. Hence, a requirement of ranges of antenna frequency bands of mobile communication equipment, such as mobile phone and notebook computer, is higher day by day.

However, with the miniaturization trend of mobile communication, in particular to the miniaturization trend of mobile phone, the space for an internal antenna is limited. Because the use of the mobile equipment usually causes the antenna to produce resonance shift on account of different intensity, wherein the type of the resonance frequency shift must be compensated by bandwidth, namely, the actual bandwidth of the antenna needs to be larger than the designed bandwidth. However, the radiation area of antenna must be increased if the bandwidth increases, so that it is important for the technician to solve the problem of making a multi-band antenna in a limited space and to meet a requirement of various communication standards.

Therefore, this is a solution for providing a multi-band antenna which has a compact size and can meet the requirement of various communication standards.

SUMMARY OF THE INVENTION

To overcome the problem of traditional technology, the present invention provides a multi-band antenna which has a compact size to meet the requirement of various communication standards.

To achieve the above objective, the present invention provides a multi-band antenna used for receiving and transmitting electromagnetic wave signals of five different bands, and comprises a substrate and an electro-conductive layer formed on the substrate. The electro-conductive layer comprises: a feed-in terminal; a ground terminal; a connecting portion extended forward from the feed-in terminal; a first high frequency portion extended leftward from a rear end of the connecting portion for controlling a third frequency band; a low frequency portion bent and extended leftward from a front end of the connecting portion for controlling a first frequency band and a second frequency band; and a second high frequency portion extended rightward from the front end of the connecting portion for controlling a fourth frequency band. Furthermore, the second high frequency portion is connected with the ground terminal and wider than the first high frequency portion; and harmonic oscillations are generated between the second high frequency portion and the first high frequency portion to control a fifth frequency band.

In one embodiment of the present invention, the low frequency portion comprises: a first low frequency arm extended leftward from the front end of the connecting portion; a bent sheet bent and extended forward from the rear end of the first low frequency arm; a second low frequency arm extended rightward from the bent sheet; and a third low frequency arm bent and extended forward and then downward from a rear end of the bent sheet; wherein the first low frequency arm, the second low frequency arm and the third low frequency arm are parallel to each other; a first gap is formed between the first low frequency arm and the second low frequency arm; a second gap is formed between the first low frequency arm and the third low frequency arm; and the second high frequency portion is disposed outside the first gap and the second gap.

In one embodiment of the present invention, the second low frequency arm is extended from a middle part of a right side of the bent sheet.

In one embodiment of the present invention, a compensation arm is bent and extended downward and then leftward from a front end of the bent sheet.

In one embodiment of the present invention, the compensation arm is perpendicularly bent leftward and then bent toward the bent sheet, and a third gap is formed between the compensation arm and the second low frequency arm.

In one embodiment of the present invention, the frequency range of the first frequency band is between 824 and 894 MHz; the frequency range of the second frequency band is between 880 and 960 MHz; the frequency range of the third frequency band is between 1710 and 1880 MHz; the frequency range of the forth frequency band is between 1850 and 1990 MHz; and the frequency range of the fifth frequency band is between 1920 and 2170 MHz.

As above mentioned, in the present invention, the harmonic oscillations/resonances are generated between the first high frequency portion and the second high frequency portion to control the fifth frequency band, so that the bandwidth of high frequency in the multi-band antenna is broadened, and the multi-band antenna can meet the requirement of various communication standards.

BRIEF DESCRIPTION OF THE DRAWINGS

The present invention will be apparent to those skilled in the art by reading the following description of a preferred embodiment of the present invention, with reference to the attached drawings, in which.

DETAILED DESCRIPTION OF THE PREFERRED EMBODIMENT

The foregoing objects, features and advantages adopted by the present invention can be best understood by referring to the following detailed description of the preferred embodiments and the accompanying drawings.

Figure 1:
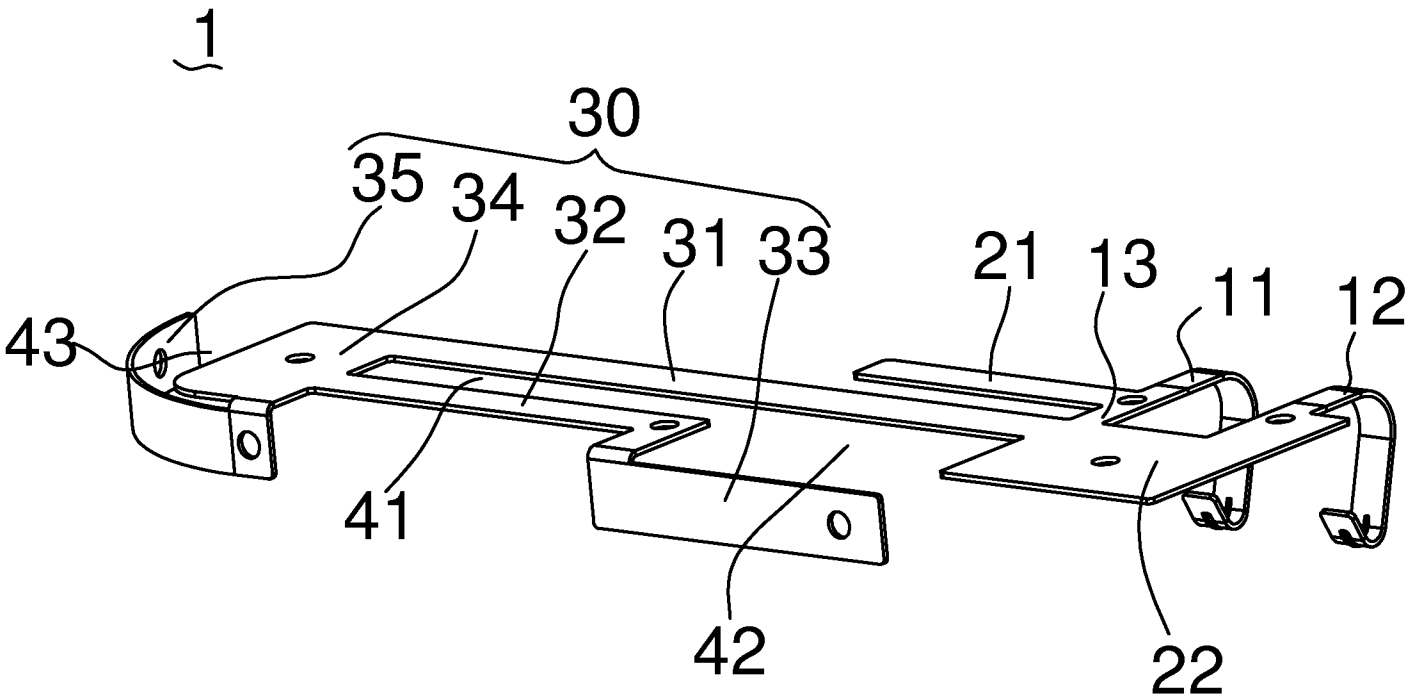
FIG. 1 is a perspective schematic view showing an electro-conductive layer of a multi-band antenna according to the present invention.
Figure 2:
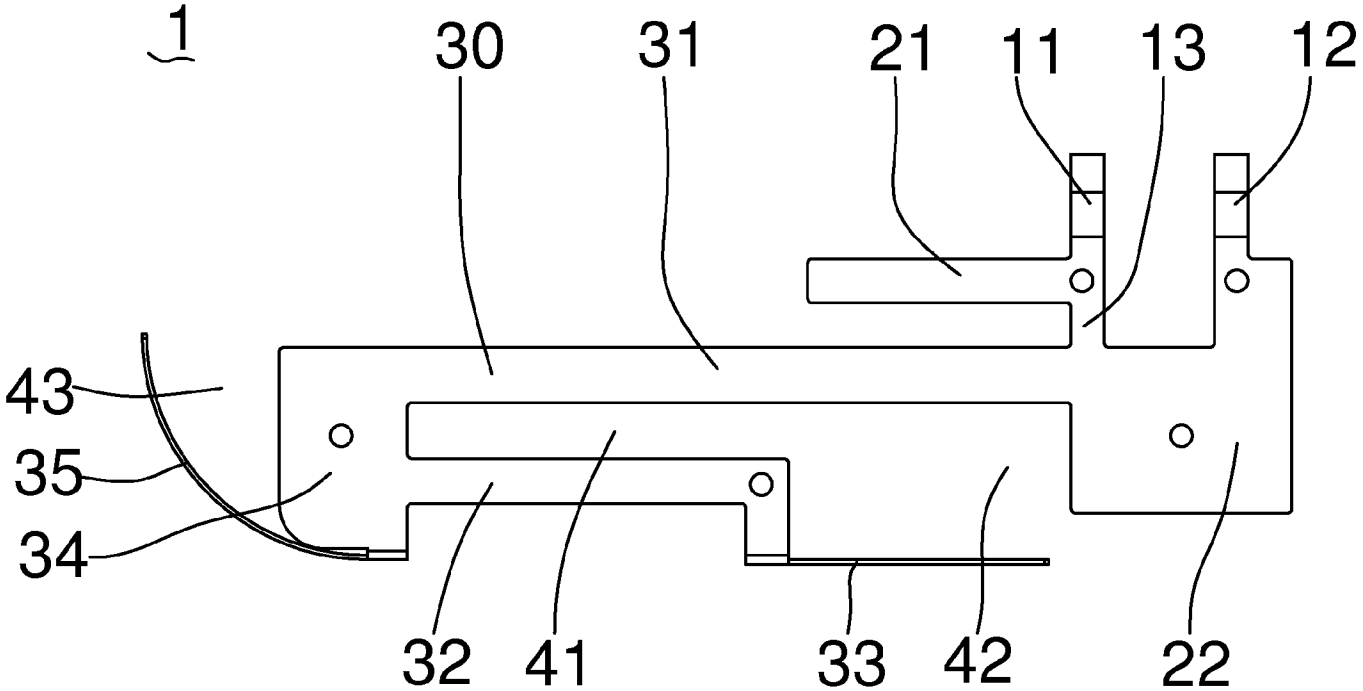
FIG. 2 is a top view of the electro-conductive layer in FIG. 1.

Referring now to FIGS. 1 and 2, a multi-band antenna according to the present invention is applied for receiving and transmitting five electromagnetic wave signals of different bands, and the multi-band antenna comprises a substrate and an electro-conductive layer 1, wherein the electro-conductive layer 1 is covered with a block cover film, and the substrate is attached with a back glue in back portion thereof.

To continue Referring to FIGS. 1 and 2, the electro-conductive layer 1 comprises a feed-in terminal 11, a ground terminal 12 which is beside the feed-in terminal 11, a connecting portion 13 extended forward from the feed-in terminal 11, a first high frequency portion 21 extended leftward from a rear end of the connecting portion 13 to controlling a third frequency band; a low frequency portion 30 bent and extended leftward from a front end of the connecting portion 13 to control a first frequency band and a second frequency band; and a second high frequency portion 22 extended rightward from the front end of the connecting portion 13 to control a fourth frequency band. Furthermore, the second high frequency portion 22 is connected with the ground terminal 12 and wider than the first high frequency portion 21; and harmonic oscillations are generated between the second high frequency portion 22 and the first high frequency portion 21 to control a fifth frequency band. In addition, the radiating portions above mentioned are both copper electroplating layer, and the ground terminal 12 and the feed-in terminal 11 are both copper gold electroplating layer.

Moreover, the frequency range of the first frequency band is between 824 and 894 MHz; the frequency range of the second frequency band is between 880 and 960 MHz; the frequency range of the third frequency band is between 1710 and 1880 MHz; the frequency range of the forth frequency band is between 1850 and 1990 MHz; and the frequency range of the fifth frequency band is between 1920 and 2170 MHz.

Specifically, to continue Referring to FIGS. 1 and 2, the low frequency portion 30 comprises: a first low frequency arm 31 extended leftward from the front end of the connecting portion 13; a bent sheet 34 bent and extended forward from the rear end of the first low frequency arm 31; a second low frequency arm 32 extended rightward from the bent sheet 34; and a third low frequency arm 33 extended forward from a rear end of the bent sheet 34 then bent extending downward. Moreover, the first low frequency arm 31, the second low frequency arm 32 and the third low frequency arm 33 are parallel to each other; a first gap 41 is formed between the first low frequency arm 31 and the second low frequency arm 32; a second gap 42 is formed between the first low frequency arm 31 and the third low frequency arm 33; and the second high frequency portion 22 is disposed outside the first gap 41 and the second gap 42.

Specifically, to continue Referring to FIGS. 1 and 2, the second low frequency arm 32 extended from a middle part of a right side of the bent sheet 34, and a compensation arm 35 is bent and extended downward and then leftward from a front end of the bent sheet 34. Besides, the compensation arm 35 is perpendicularly bent leftward and then bent toward the bent sheet 34, and a third gap 43 is formed between the compensation arm 35 and the second low frequency arm 32. Moreover, the bandwidth of the low frequency portion 30 is broadened by the compensation arm 35 and the third gap 43 (with a half arc shape), and the needed area of the present invention is reduced by the third low frequency arm 33 (perpendicular to a surface of the substrate) and the compensation arm 35.

Furthermore, the first high frequency portion 21 is 2 mm in width and 11.9 mm in length; the second high frequency portion 22 is 10 mm in width and 11.5 mm in length; the first low frequency arm 31 is 30 mm in length and 2.5 mm in width; the second low frequency arm 32 is 15.3 mm in length and 2 mm in width; the third low frequency arm 33 is 13.7 mm in length and 2.6 mm in width; the first gap 41 is 2.55 mm in width; and the compensation arm 35 is 11.8 mm in length and 2.4 mm in width.

Referring now to FIGS. 1 and 2, when the present invention is in operation, the high frequency and low frequency signals is enter the connecting portion 13 from the feed-in terminal 11, and enter the radiating portions (the first high frequency portion 21, the second high frequency portion 22, and the low frequency portion 30) along the connecting portion 13. Then, the high frequency signals (the frequency band of GMS1710-GMS1880) are radiated by the first high frequency portion 21; the high frequency signals (the frequency band of GMS1850-GMS1990) are radiated by the second high frequency portion 22; the high frequency signals (the frequency band of GMS1850-GMS1990) are radiated by the resonance of the first high frequency portion 21 and the second high frequency portion 22, and the low frequency signals (the frequency band of GMS824-GMS960) are radiated by the low frequency portion 30.

As above mentioned, in the present invention, the resonance is produced between the first high frequency portion 21 and the second high frequency portion 22, and controls the fifth frequency band, so that the multi-band antenna can broaden the bandwidth of high frequency, and to meet the requirement of various communication standards.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A multi-band antenna, receiving and transmitting electromagnetic wave signals of different bands, and comprising a substrate and an electro-conductive layer formed on the substrate; wherein the electro-conductive layer comprises:

a feed-in terminal;

a ground terminal;

a connecting portion extended forward from the feed-in terminal;

a first high frequency portion extended leftward from a rear end of the connecting portion to control a third frequency band;

a low frequency portion bent and extended leftward from a front end of the connecting portion to control a first frequency band and a second frequency band; and a second high frequency portion extended rightward from the front end of the connecting portion to control a fourth frequency band;

wherein the second high frequency portion is connected with the ground terminal and wider than the first high frequency portion; and harmonic oscillations are generated between the second high frequency portion and the first high frequency portion to control a fifth frequency band;

wherein the low frequency portion comprises:

a first low frequency arm extended leftward from the front end of the connecting portion;

a bent sheet bent and extended forward from the rear end of the first low frequency arm;

a second low frequency arm extended rightward from the bent sheet; and a third low frequency arm bent and extended forward and then downward from a rear end of the bent sheet;

wherein the first low frequency arm, the second low frequency arm and the third low frequency arm are parallel to each other; a first gap is formed between the first low frequency arm and the second low frequency arm; a second gap is formed between the first low frequency arm and the third low frequency arm; and the second high frequency portion is disposed outside the first gap and the second gap.

2. The multi-band antenna as claimed in claim 1, wherein the second low frequency arm is extended from a middle part of a right side of the bent sheet.

3. The multi-band antenna as claimed in claim 1, wherein a compensation arm is bent and extended downward and then leftward from a front end of the bent sheet.

4. The multi-band antenna as claimed in claim 3, wherein the compensation arm is perpendicularly bent leftward and then bent toward the bent sheet, and a third gap is formed between the compensation arm and the second low frequency arm.

5. The multi-band antenna as claimed in claim 1, wherein the frequency range of the first frequency band is between 824 and 894 MHz; the frequency range of the second frequency band is between 880 and 960 MHz; the frequency range of the third frequency band is between 1710 and 1880 MHz; the frequency range of the forth frequency band is between 1850 and 1990 MHz; and the frequency range of the fifth frequency band is between 1920 and 2170 MHz.

* * * * *